US010117507B2

(12) United States Patent
Sobus

(10) Patent No.: US 10,117,507 B2
(45) Date of Patent: Nov. 6, 2018

(54) ROOF CLEANING SYSTEM

(71) Applicant: Jeffery Sobus, Waterloo, NY (US)

(72) Inventor: Jeffery Sobus, Waterloo, NY (US)

( * ) Notice: Subject to any disclaimer, the term of this patent is extended or adjusted under 35 U.S.C. 154(b) by 3 days.

(21) Appl. No.: 15/272,001

(22) Filed: Sep. 21, 2016

(65) Prior Publication Data

US 2018/0078029 A1 Mar. 22, 2018

(51) Int. Cl.

| | |
|---|---|
| ***A47L 11/38*** | (2006.01) |
| ***E04D 15/00*** | (2006.01) |
| ***A46B 13/00*** | (2006.01) |
| ***B66F 11/04*** | (2006.01) |

(52) U.S. Cl.
CPC ..... *A46B 13/001* (2013.01); *A47L 11/38* (2013.01); *B66F 11/046* (2013.01); *E04D 15/006* (2013.01)

(58) Field of Classification Search
CPC ..... A46B 13/001; A47L 11/38; B60S 3/06; E04D 15/006
See application file for complete search history.

(56) References Cited

U.S. PATENT DOCUMENTS

| | | | | |
|---|---|---|---|---|
| D201,287 | S | 6/1965 | Brennan | |
| 3,439,372 | A * | 4/1969 | Collier | B66F 11/046 15/50.1 |
| 3,460,177 | A * | 8/1969 | Rhinehart | B08B 1/00 15/50.1 |
| 4,070,771 | A | 1/1978 | Yakiwchuk | |
| 5,092,012 | A * | 3/1992 | Rabourn | B64F 5/30 15/53.1 |
| 5,161,318 | A | 11/1992 | Bergman et al. | |
| 5,394,959 | A | 3/1995 | Cullity et al. | |
| 5,570,524 | A | 11/1996 | Groat | |
| 6,654,978 | B2 | 12/2003 | Bouchard | |
| 8,065,823 | B2 | 11/2011 | Morrell | |
| 8,225,450 | B2 | 7/2012 | Petersen | |

FOREIGN PATENT DOCUMENTS

DE 10 2011 103 028 A1 * 12/2012

* cited by examiner

*Primary Examiner* — Randall Chin

(57) ABSTRACT

A roof cleaning system for removing snow from a roof includes a crane that has a boom and a man box that is coupled to the boom. The crane positions the man box above a roof of a building. A sweeper is coupled to the man box and the sweeper sweeps snow from the roof. The sweeper is operationally coupled to the crane.

10 Claims, 5 Drawing Sheets

ROOF CLEANING SYSTEM

BACKGROUND OF THE DISCLOSURE

Field of the Disclosure

The disclosure relates to roof cleaning devices and more particularly pertains to a new roof cleaning device for removing snow from a roof.

SUMMARY OF THE DISCLOSURE

An embodiment of the disclosure meets the needs presented above by generally comprising a crane that has a boom and a man box that is coupled to the boom. The crane positions the man box above a roof of a building. A sweeper is coupled to the man box and the sweeper sweeps snow from the roof. The sweeper is operationally coupled to the crane.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
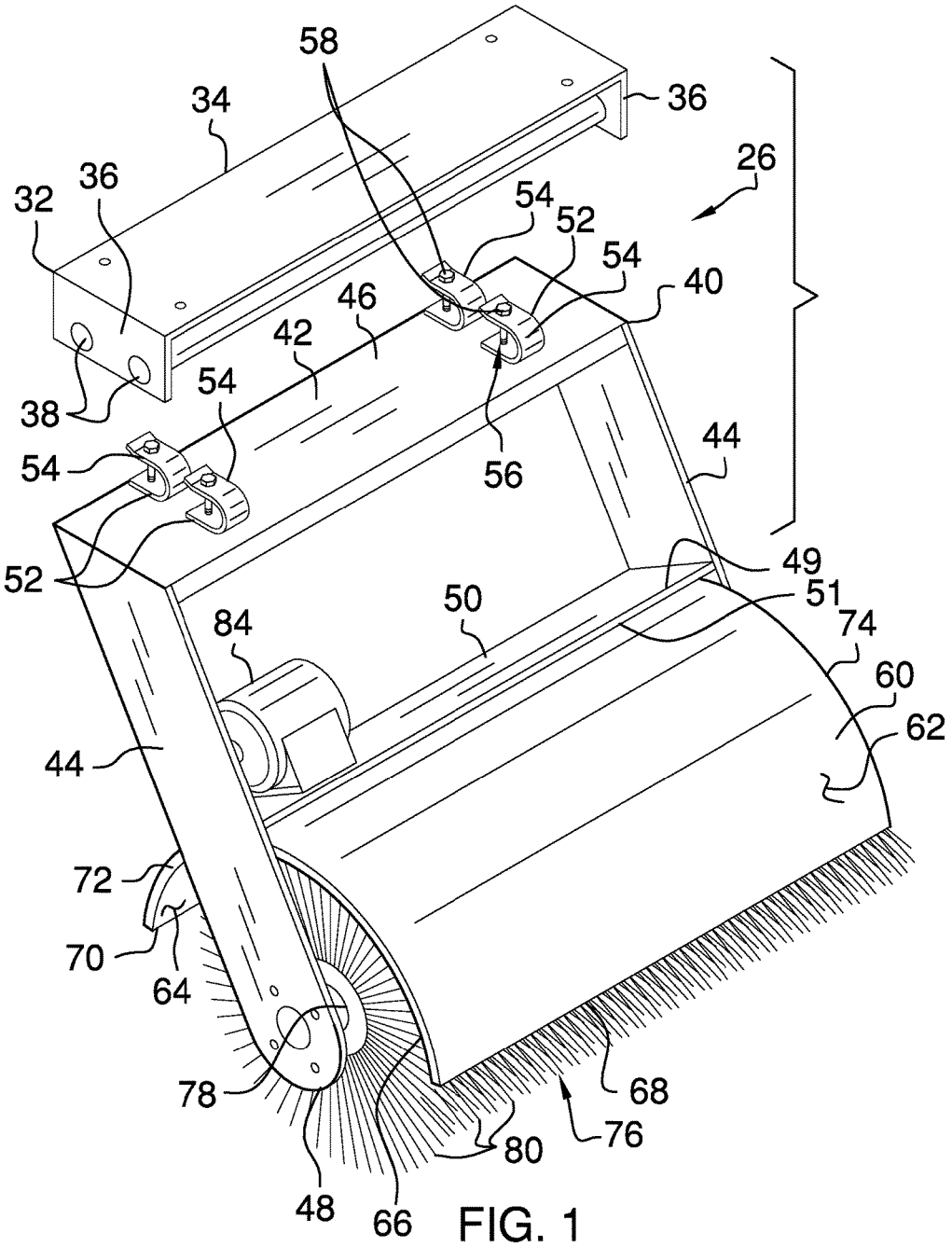
FIG. 1 is a front perspective view of a sweeper of a cleaning system according to an embodiment of the disclosure.
Figure 2:
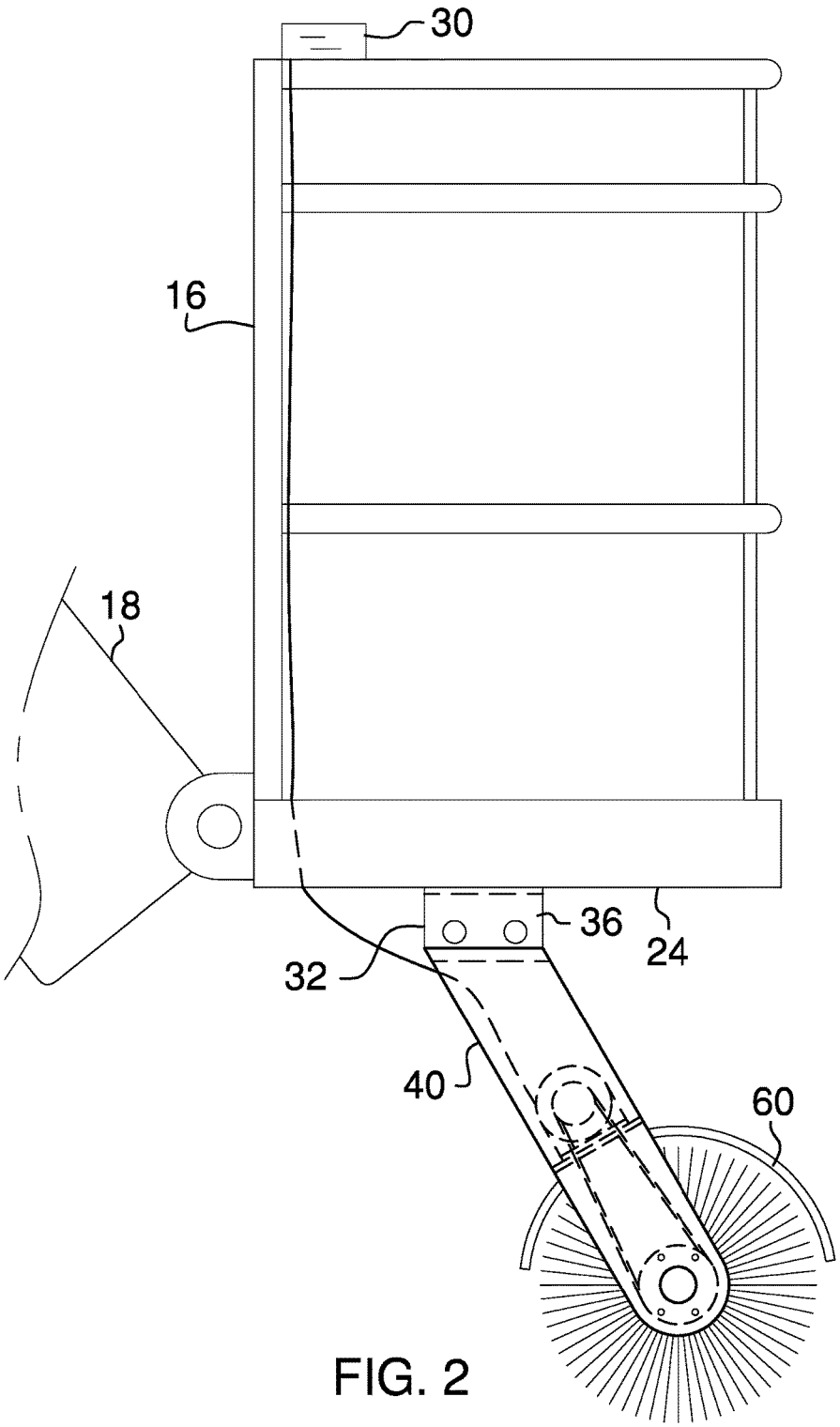
FIG. 2 is a right side view of an embodiment of the disclosure.
Figure 3:
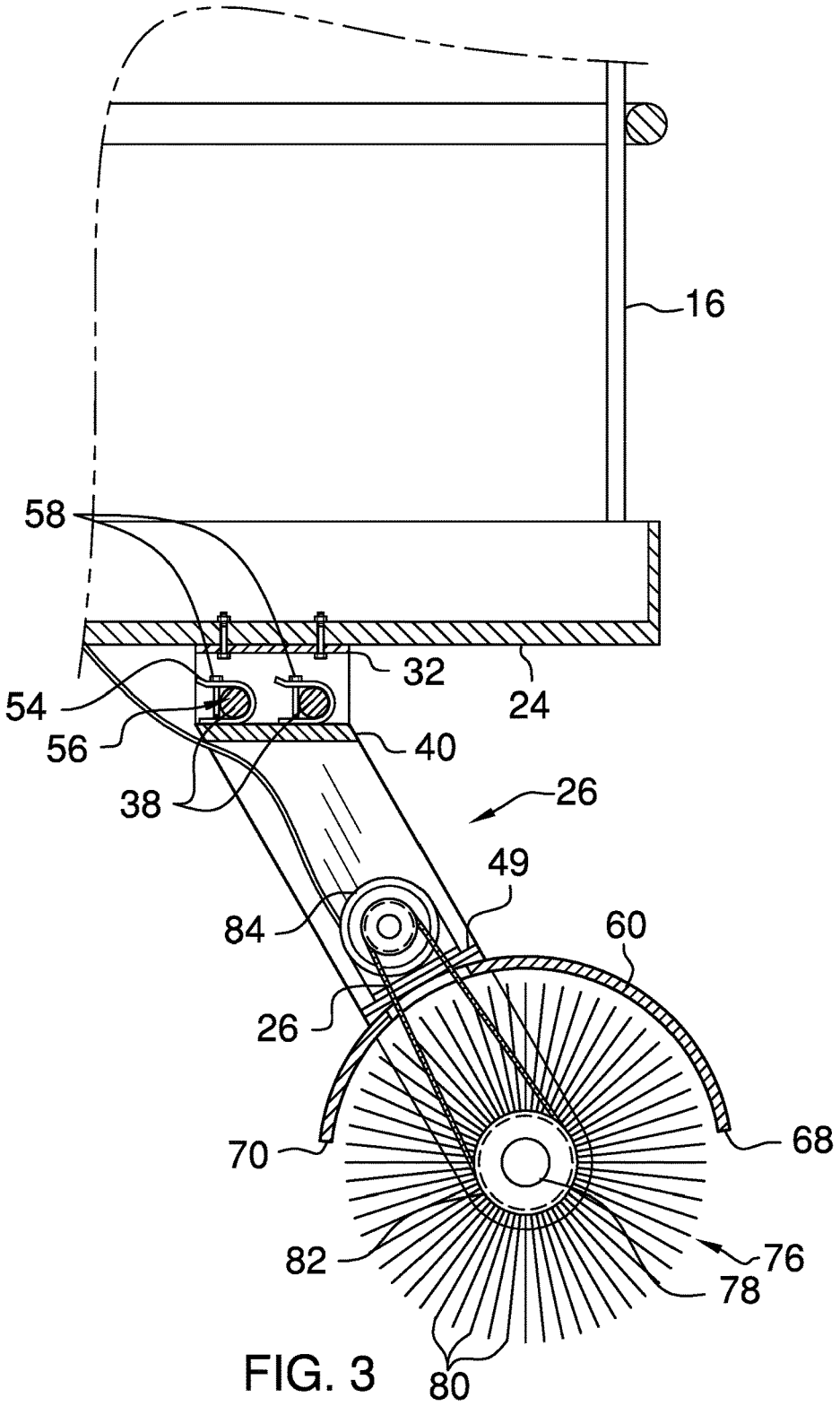
FIG. 3 is a right side cut-away view of an embodiment of the disclosure.
Figure 5:
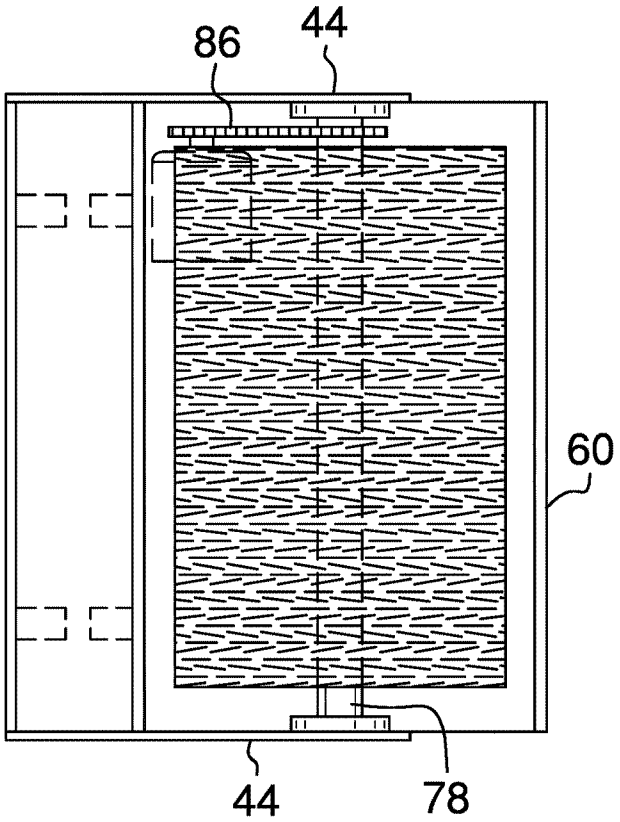
FIG. 5 is a bottom view of an embodiment of the disclosure.
Figure 4:
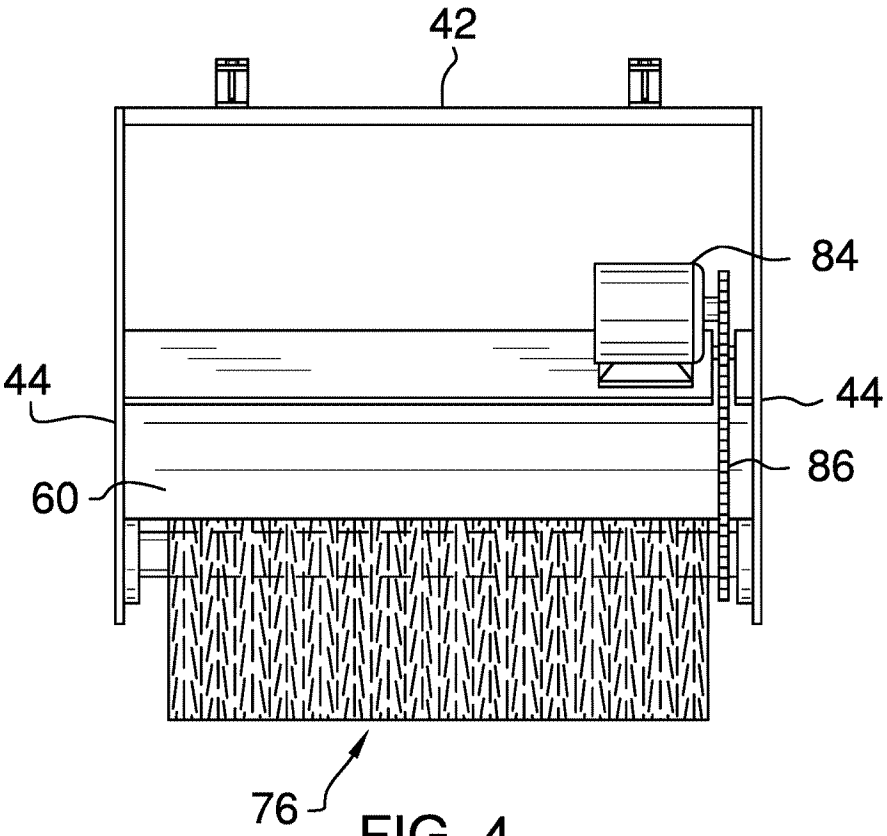
FIG. 4 is a back view of an embodiment of the disclosure.
Figure 6:
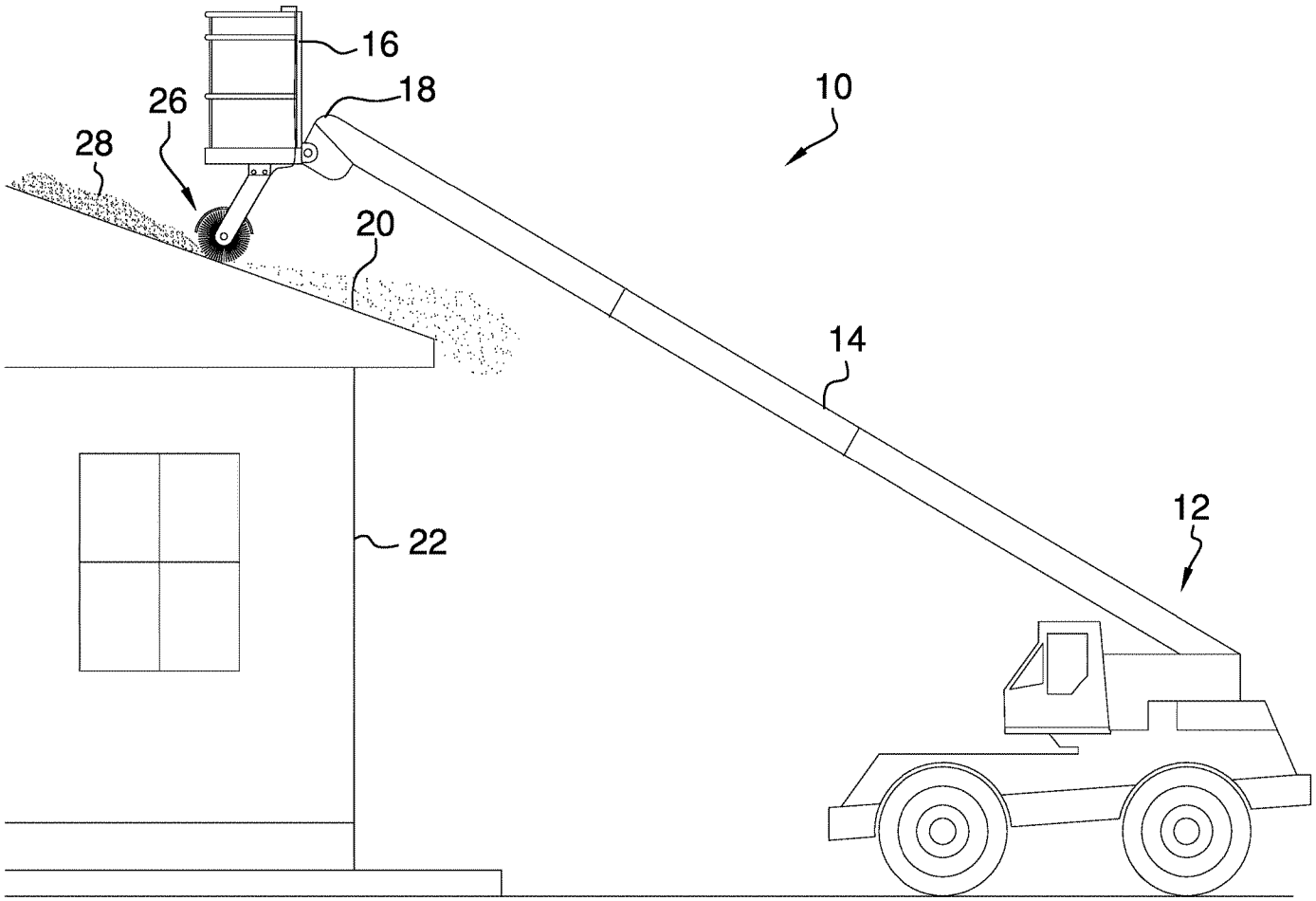
FIG. 6 is a perspective in-use view of an embodiment of the disclosure.

With reference now to the drawings, and in particular to FIGS. 1 through 6 thereof, a new roof cleaning device embodying the principles and concepts of an embodiment of the disclosure and generally designated by the reference numeral 10 will be described.

As best illustrated in FIGS. 1 through 6, the roof cleaning system 10 generally comprises a crane 12 that has a boom 14 and a man box 16. The boom 14 has a distal end 18 with respect to the crane 12 and the man box 16 is coupled to the distal end 18. The crane 12 positions the man box 16 above a roof 20 of a building 22. The man box 16 has a bottom side 24 and the crane 12 may be a mechanical crane of any conventional design.

A sweeper 26 is coupled to the man box 16 and the sweeper 26 sweeps debris 28 from the roof 20. The debris 26 may comprise snow or the like. The sweeper 26 is operationally coupled to the crane 12. The sweeper 26 comprises a control 30 that is coupled to the man box 16. Thus, the control 30 may be manipulated. The control 30 is electrically coupled to the crane 12. The control 30 may comprise an electrical control box that controls operational parameters of the sweeper 26.

A first mount 32 is provided that has a central member 34 extending between a pair of lateral tabs 36. The lateral tabs 36 are spaced apart from each other. The central member 34 is coupled to the bottom side 24 of the man box 16. A pair of bars 38 is provided and each of the bars 38 extends between the pair of lateral tabs 36. Each of the bars 38 is spaced from the central member 34 and the bars 38 are spaced apart from each other.

A second mount 40 is provided. The second mount 40 has a middle plate 42 extending between a pair of end plates 44. The end plates 44 are spaced apart from each other such that the second mount has a U-shape. Each of the end plates 44 angles forwardly from the middle plate 42. The middle plate 42 has a top side 46.

Each of the end plates 44 has a distal end 48 with respect to the middle plate 42. The second mount 40 includes a medial plate 49 extending between the end plates 44. The medial plate 49 is positioned between the distal end 48 corresponding to the end plates 44 and the middle plate 42. The medial plate 49 has an upper side 50 and a lower side 51.

A plurality of brackets 52 is provided. Each of the brackets 52 is coupled to the top side 46 of the middle plate 42. Each of the brackets 52 includes an arm 54 that is spaced from the middle plate 42 to define a space 56 between the arm 54 corresponding to each of the brackets 52 and the middle plate 42. The arm 54 corresponding to each bracket 52 is oriented coplanar with the top side 46 of the middle plate 42. The brackets 52 are spaced apart from each other and distributed on the middle plate 42. Each of the bars 38 is positioned in the space 56 of an associated one of the brackets 52. Thus, the second mount 40 is removably coupled to the first mount 32.

A plurality of fasteners 58 is provided. Each of the fasteners 58 extends through the arm 54 of an associated bracket 52 and engages the middle plate 42. Thus, the fasteners 58 inhibit the bars 38 from being urged out of the brackets 52. Each of the fasteners 58 may comprise a bolt or the like.

A shield 60 is provided. The shield 60 has a top surface 62, a bottom surface 64 and a peripheral edge 66 extending between the top surface 62 and the bottom surface 64. The peripheral edge 66 has a front side 68, a back side 70, a first lateral side 72 and a second lateral side 74. The shield 60 is curved between the front side 68 and the back side 70 such that the shield 60 forms a trough. The top surface 62 is coupled to the lower side 51 of the medial plate 49. Thus, each of the front side 68 and the back side 70 are directed toward the distal end 48 corresponding to each of the end plates 44. Each of the first lateral side 72 and the second lateral side 74 abuts an associated one of the end plates 44.

A brush 76 is rotatably coupled between the end plates 44. The brush 76 is positioned adjacent to the distal end 48 corresponding to each of the end plates 44. Thus, the brush 76 is positioned beneath the shield 60. The brush 76 frictionally engages the roof 20 when the man box 16 is positioned near the roof 20. The brush 76 may comprise a shaft 78 rotatably between the end plates 44 and a plurality of bristles 80 extending outwardly from the shaft 78. A gear 82 is coupled to the brush 76. The gear 82 may be positioned around the shaft 78.

A motor 84 is coupled to the medial plate 49. The motor 84 is positioned between the medial plate 49 and the middle plate 42. The motor 84 is electrically coupled to the control 30 such that the control 30 turns the motor 84 on and off. The motor 84 may comprise an electric motor or the like. A chain 86 is coupled between the motor 84 and the gear 82 such that the motor 84 rotates the brush 76 when the motor 84 is turned on. Thus, the brush 76 may frictionally engage the debris 28 on the roof 20 thereby facilitating the brush 76 to sweep the debris 28 from the roof 20.

In use, the crane 12 maneuvers the man box 16 to be positioned over the roof 20. An operator is positioned in the man box 16 and the operator manipulates the control 30. The man box 16 is maneuvered to position the brush 76 against the roof 20. Thus, the brush 76 sweeps the debris 28 from the roof 20 when the motor 84 is turned on. The man box 16 is maneuvered to remove the debris 28 from the entire area of the roof 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roof cleaning system comprising:

a crane having a boom and a man box being coupled to said boom, said crane being configured to position said man box above a roof of a building; and a sweeper being coupled to said man box wherein said sweeper is configured to sweep debris from the roof, said sweeper being operationally coupled to said crane;

a first mount being coupled to a bottom side of said man box; and a second mount having a middle plate extending between a pair of end plates, said end plates being spaced apart from each other such that said second mount has a U-shape, each of said end plates angling away from said middle plate, said middle plate having a top side, each of said end plates having a distal end with respect to said middle plate, said second mount having a medial plate extending between said end plates, said medial plate being positioned between said distal end corresponding to said end plates and said middle plate.

2. The system according to claim 1, wherein said sweeper comprises a control being coupled to said man box wherein said control is configured to be manipulated, said control being electrically coupled to said crane.

3. The system according to claim 1, further comprising said first mount having a central member extending between a pair of lateral tabs, said lateral tabs being spaced apart from each other, said central member being coupled to said bottom side of said man box.

4. The system according to claim 1, further comprising:

a first mount having a pair of bars; and a plurality of brackets, each of said brackets being coupled to said top side of said middle plate, said of said brackets having an arm being spaced from said middle plate to define a space between said arm corresponding to each of said brackets and said middle plate, said brackets being spaced apart from each other and distributed on said middle plate, each of said bars being positioned in said space of an associated one of said brackets such that said second mount is removably coupled to said first mount.

5. The system according to claim 1, further comprising a shield having a top surface, a bottom surface and a peripheral edge extending between said top surface and said bottom surface, said peripheral edge having a front side, a back side, a first lateral side and a second lateral side, said shield being curved between said front side and said back side such that said shield forms a trough, said top surface being coupled to said medial plate such said each of said front side and said back side are directed toward said distal end corresponding to each of said end plates, each of said first lateral side and said second lateral side abutting an associated one of said end plates.

6. The system according to claim 5, further comprising a brush being rotatably coupled between said end plates, said brush being positioned adjacent to said distal end corresponding to each of said end plates such that said brush is positioned beneath said shield, said brush being configured to frictionally engage the roof.

7. The system according to claim 1, further comprising:

a control; and a motor being coupled to said medial plate, said motor being positioned between said medial plate and said middle plate, said motor being electrically coupled to said control such that said control turns said motor on and off.

8. The system according to claim 7, further comprising:

a brush; and a chain being coupled between said motor and said brush such that said motor rotates said brush when said motor is turned on wherein said brush is configured to frictionally engage debris on the roof thereby facilitating said brush to sweep the debris from the roof.

9. A roof cleaning system comprising:

a crane having a boom and a man box being coupled to said boom, said crane being configured to position said man box above a roof of a building;

a sweeper being coupled to said man box wherein said sweeper is configured to sweep debris from the roof, said sweeper being operationally coupled to said crane;

a first mount having a central member extending between a pair of lateral tabs, said lateral tabs being spaced apart from each other, said central member being coupled to a bottom side of said man box; and a pair of bars, each of said bars extending between said pair of lateral tabs, each of said bars being spaced from said central member, said bars being spaced apart from each other.

10. A roof cleaning system comprising:

a crane having a boom and a man box being coupled to said boom, said crane being configured to position said man box above a roof of a building, said man box having a bottom side; and a sweeper being coupled to said man box wherein said sweeper is configured to sweep debris from the roof, said sweeper being operationally coupled to said crane, said sweeper comprising:

a control being coupled to said man box wherein said control is configured to be manipulated, said control being electrically coupled to said crane, a first mount having a central member extending between a pair of lateral tabs, said lateral tabs being spaced apart from each other, said central member being coupled to said bottom side of said man box, a pair of bars, each of said bars extending between said pair of lateral tabs, each of said bars being spaced from said central member, said bars being spaced apart from each other, a second mount having a middle plate extending between a pair of end plates, said end plates being spaced apart from each other such that said second mount has a U-shape, each of said end plates angling away from said middle plate, said middle plate having a top side, each of said end plates having a distal end with respect to said middle plate, said second mount having a medial plate extending between said end plates, said medial plate being positioned between said distal end corresponding to said end plates and said middle plate, a plurality of brackets, each of said brackets being coupled to said top side of said middle plate, said of said brackets having an arm being spaced from said middle plate to define a space between said arm corresponding to each of said brackets and said middle plate, said brackets being spaced apart from each other and distributed on said middle plate, each of said bars being positioned in said space of an associated one of said brackets such that said second mount is removably coupled to said first mount, a shield having a top surface, a bottom surface and a peripheral edge extending between said top surface and said bottom surface, said peripheral edge having a front side, a back side, a first lateral side and a second lateral side, said shield being curved between said front side and said back side such that said shield forms a trough, said top surface being coupled to said medial plate such said each of said front side and said back side are directed toward said distal end corresponding to each of said end plates, each of said first lateral side and said second lateral side abutting an associated one of said end plates, a brush being rotatably coupled between said end plates, said brush being positioned adjacent to said distal end corresponding to each of said end plates such that said brush is positioned beneath said shield, said brush being configured to frictionally engage the roof, a motor being coupled to said medial plate, said motor being positioned between said medial plate and said middle plate, said motor being electrically coupled to said control such that said control turns said motor on and off, and a chain being coupled between said motor and said brush such that said motor rotates said brush when said motor is turned on wherein said brush is configured to frictionally engage debris on the roof thereby facilitating said brush to sweep the debris from the roof.

* * * * *